US007988214B2

(12) United States Patent
Grizzle

(10) Patent No.: US 7,988,214 B2
(45) Date of Patent: Aug. 2, 2011

(54) CARGO SPREADER BAR

(76) Inventor: Roger D. Grizzle, Eden, GA (US)

( * ) Notice: Subject to any disclaimer, the term of this patent is extended or adjusted under 35 U.S.C. 154(b) by 274 days.

(21) Appl. No.: 12/311,996

(22) PCT Filed: Oct. 11, 2007

(86) PCT No.: PCT/US2007/021713
§ 371 (c)(1),
(2), (4) Date: Apr. 22, 2009

(87) PCT Pub. No.: WO2008/063307
PCT Pub. Date: May 29, 2008

(65) Prior Publication Data
US 2009/0273200 A1 Nov. 5, 2009

(51) Int. Cl.
*B66C 1/16* (2006.01)

(52) U.S. Cl. ..... 294/81.5; 294/75; 294/81.56

(58) Field of Classification Search ..... 294/74, 294/75, 81.1, 81.2, 81.5, 81.51, 81.54, 81.55, 294/81.56, 82.19, 82.2, 82.21
See application file for complete search history.

(56) References Cited

U.S. PATENT DOCUMENTS

| | | | |
|---|---|---|---|
| 1,221,693 | A | 4/1917 | Crosby |
| 3,079,193 | A | 2/1963 | Brewer, Jr. |
| 3,220,761 | A | 11/1965 | Himel, Jr. |
| 3,493,258 | A | 2/1970 | Wyrough |
| 3,865,422 | A | 2/1975 | Archer |
| 3,899,205 | A | 8/1975 | Lanigan et al. |
| 4,251,099 | A | 2/1981 | Hubalek et al. |
| 4,293,155 | A | 10/1981 | Grant |
| 4,462,627 | A | 7/1984 | Kudlicka |
| 6,991,274 | B2 | 1/2006 | Brooks |
| 2003/0222468 | A1 | 12/2003 | Brooks |

FOREIGN PATENT DOCUMENTS

JP 6-144769 5/1994

*Primary Examiner* — Dean J Kramer
(74) *Attorney, Agent, or Firm* — Richard C. Litman

(57) ABSTRACT

The cargo spreader bar (100) is a rectangular frame with longitudinal sides (120) that are longer than the lateral sides (118*e*). Hooks (102) are attached to the frame along the longitudinal sides (120). The hooks (102) hold cargo hoisting chains (CH) and include actuator (206) controlled, pivoting safety locks (208) that close to secure the chains (CH) to the hooks (102). A tubular chain lifter (104) pivotally mounted to the frame extends along one of the longitudinal frame members (120). A second chain lifter (104) extends along the remaining longitudinal frame member (120). Inside sections of the tubular chain lifters (104) are pivotally coupled to a chain lifter actuator (400). When safety locks (208) are disengaged, an actuator arm (401) can be commanded to pivot the outside sections of the lifters (104) to swing upward to release the chains (CH) from the hooks (102).

10 Claims, 5 Drawing Sheets

CARGO SPREADER BAR

TECHNICAL FIELD

The present invention relates generally to cargo lifting devices, and more particularly to a cargo spreader bar having the capability of carrying out various cargo loading and unloading operations without requiring the use of pneumatic hooks and associated air hoses.

BACKGROUND ART

Currently, stevedores and other longshoremen must lift and handle several pneumatic hooks, which each weigh about thirty pounds, in order to hook cargo up to the spreader bar. The process is exhausting manual labor, and may lead to back injuries through job-related accidents or occupational disease. Since there can be upward of seven or more of these pneumatic hooks on each side of the spreader bar, each of the hooks having its own individual air hose for actuation, pneumatic leaks pose a constant problem, as well as the difficulty in manipulating so many hooks attached to separate air hoses. Productivity is lost when a stevedore is injured handling the pneumatic hooks, and also when the system must be shut down to troubleshoot an air leak amidst the complex array of supply hoses for the pneumatic hooks.

Thus, a cargo spreader bar solving the aforementioned problems is desired.

DISCLOSURE OF INVENTION

The disclosure is directed to a cargo spreader bar. The cargo spreader bar has a pair of longitudinal frame members and a pair of end members that define a substantially rectangular frame. A plurality of lateral cross members extend across the rectangular frame. A plurality of outwardly disposed hooks are slidably attachable to and extending below each of the longitudinal frame members. Each of the hooks has a point defining an open mouth. The cargo spreader bar also includes a plurality of chains. Each of the chains has a first end that is pivotally attached to a lower rear section of the hooks, and a second end that is releasably attached over the point of the corresponding hook so that the chains form loops for lifting cargo. Pivoting safety locking members are attached to the hooks. The locking members are pivotal across the mouth of the hooks so that the locking members secure the chain loops within the hooks. The cargo spreader bar has at least one safety locking member control actuator that is attached to the frame. The safety locking member control actuator selectively pivots the locking members open and closed across the mouths of the hooks.

For each longitudinal frame member, there is a chain lifter that is pivotally attached to the frame. Each of the chain lifters has an outboard elongated longitudinal rail that is selectively pivotal upward parallel to the frame to lift the chains upward and release the second ends of the chains from the hooks when the locking members are pivoted open. A chain lifter actuator is connected to the chain lifters.

BRIEF DESCRIPTION OF THE DRAWINGS

Similar reference characters denote corresponding features consistently throughout the attached drawings.

BEST MODES FOR CARRYING OUT THE INVENTION

The cargo spreader bar is a rectangular frame having longitudinal sides longer than lateral sides. Hooks are attached to the frame along the longitudinal sides. The hooks hold cargo hoisting chains and include actuator controlled, pivoting safety locks that close to secure the chain loops. A tubular chain lifter pivotally mounted to the frame extends along one of the longitudinal frame members. A second chain lifter extends along the remaining longitudinal frame member. Inside sections of the tubular chain lifters are pivotally coupled to a chain lifter actuator.

When safety locks are disengaged, an actuator arm can be commanded to extend downward to cause inside sections of the chain lifters to swing downward. The pivotal attachments of the tubular chain lifters permit the outside sections of the lifters to swing upward, coming into contact with the chains as the inside sections swing downward, thereby releasing the chains from the hooks.

Loading another cargo comprises keeping the safety locks open; placing the chains on the hooks; then closing the safety locks. After the cargo is transported to a desired position, the safety locks are then opened and the chain lifters are activated to release the chains.

Figure 1A:
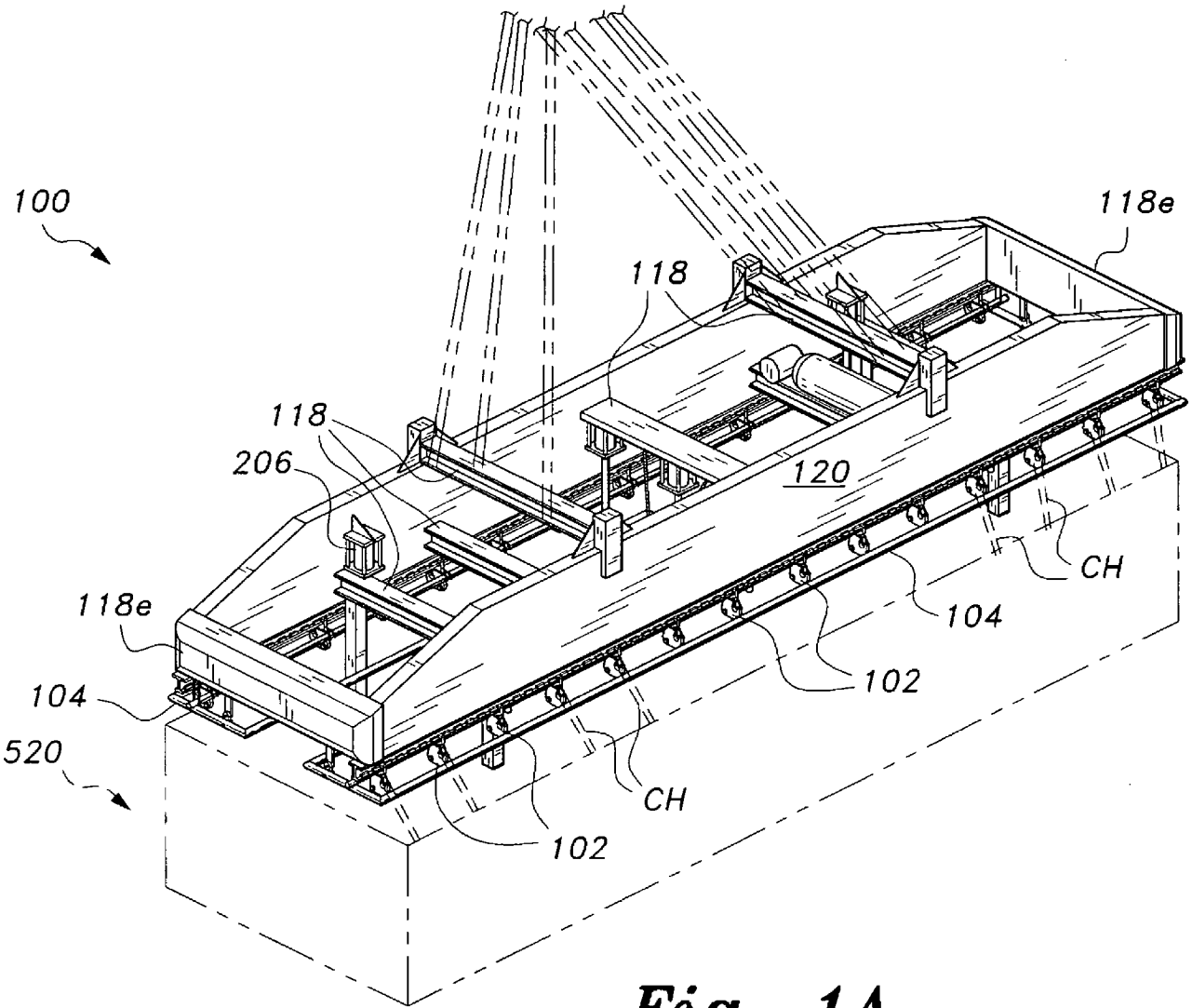
FIG. 1A is an environmental, perspective view of a cargo spreader bar according to the present invention.
Figure 1B:
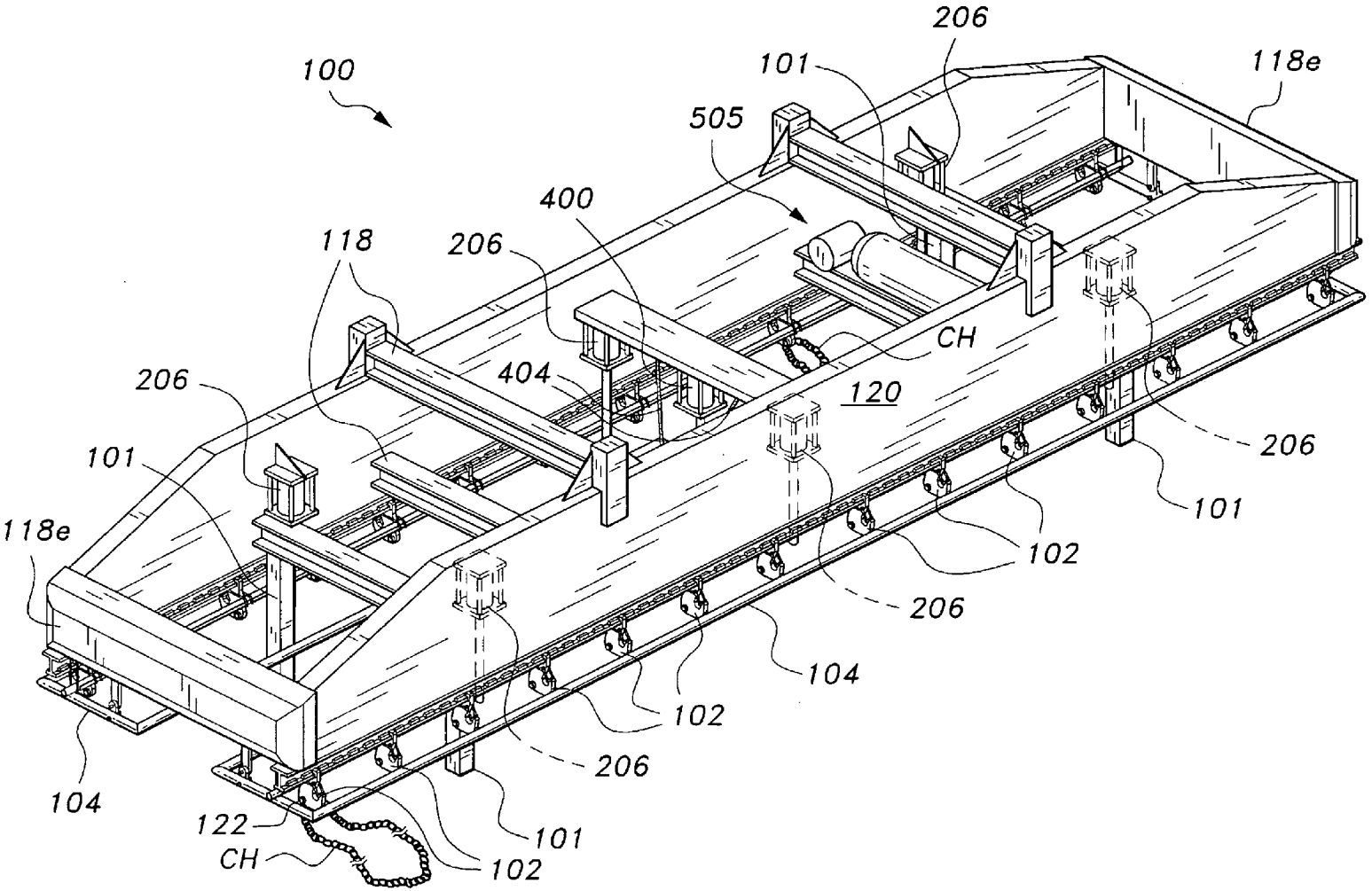
FIG. 1B is a perspective view of a cargo spreader bar according to the present invention.
Figure 2:
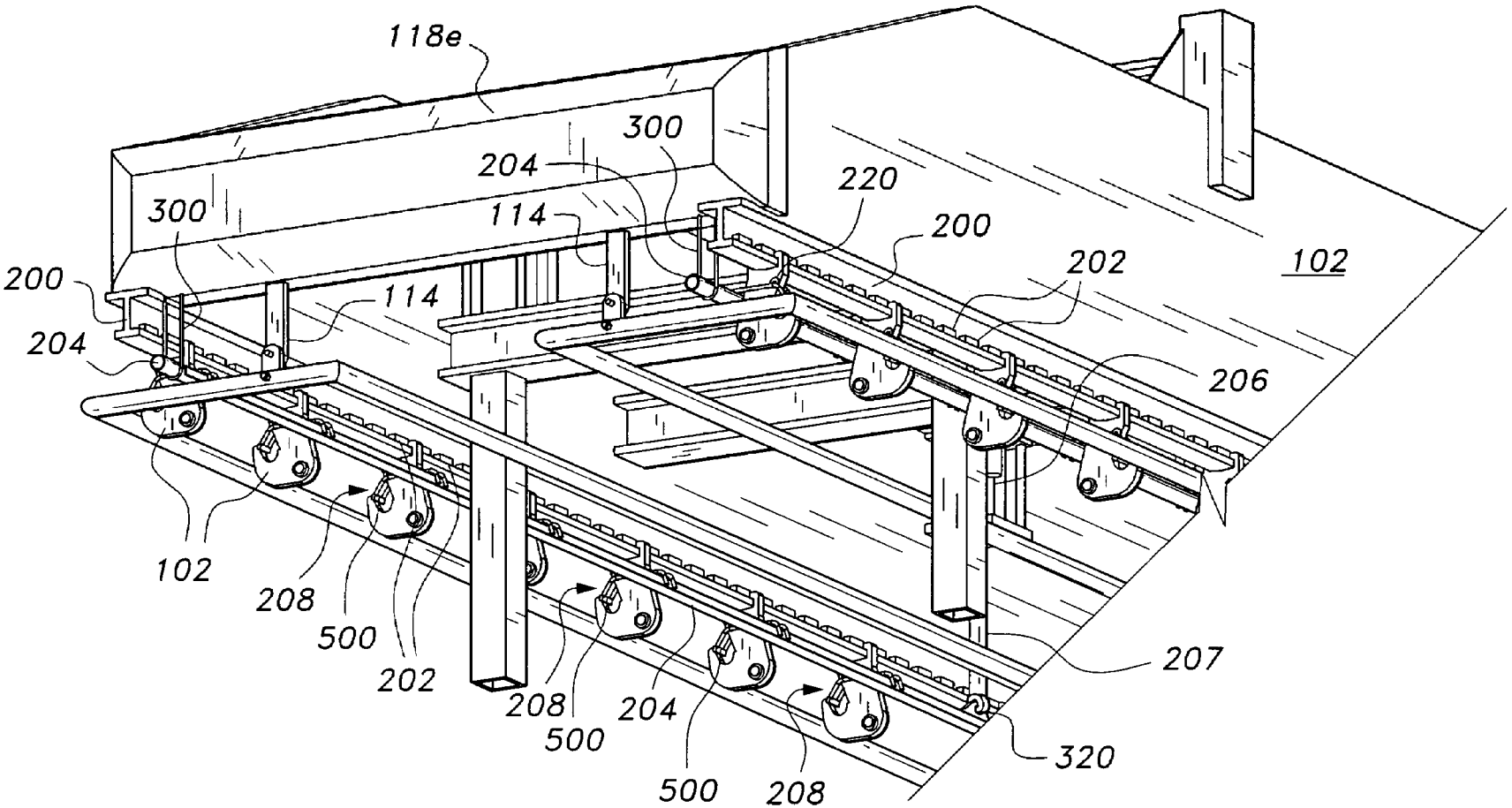
FIG. 2 is a partial perspective view of the cargo spreader bar according to the present invention.

The cargo spreader bar of the current invention is generally shown in FIGS. 1A, 1B and 2. The cargo spreader bar 100 has a substantially rectangular, preferably steel frame defined by two longitudinal frame members 120 and lateral cross members 118*e* , with a plurality of medially located lateral cross members 118 extending across the frame. Longitudinal frame members 120 may have vertically tapered leading and trailing sections (also referred to herein as front and rear sections). The spreader bar 100 may have a plurality of vertically disposed stand off members 101. As is known in the art, an upper surface of the spreader bar can have the appropriate attachment devices preferably disposed on or along upper lateral cross members 118 so that the spreader bar 100 can be gantried and/or suspended for movement of cargo 520 between a cargo loading location and a cargo unloading location.

Additionally, the spreader bar 100 has hooks 102, which are preferably of a solid body steel design, that can be slid into the frame within notched regions, i.e., slots 202, of a hook attachment rail, i.e., "T" bar 200, to provide a secure yet removable attachment along the T bar 200, which, in turn, is rigidly attached to its associated longitudinal frame member 120.

As shown in FIG. 2, the hooks 102 have hanger arms that fit into the T bar slots 202 in order to hang the hooks 102 from the T-bar 200. The hooks 102 are capable of holding cargo hoisting chain loops CH and include actuator-controlled, pivoting safety locking members 208 that can close across the mouth of the hook 102 in response to a mechanical input from a plurality of safety actuators 206 to secure the chain loops CH to the hooks 102. In the embodiment shown, each chain has an end link 122 pivotally attached to a lower rear section of the solid-bodied hook 102 through a hole 122*a* (seen in FIG. 3) provided for the purpose.

Figure 3:
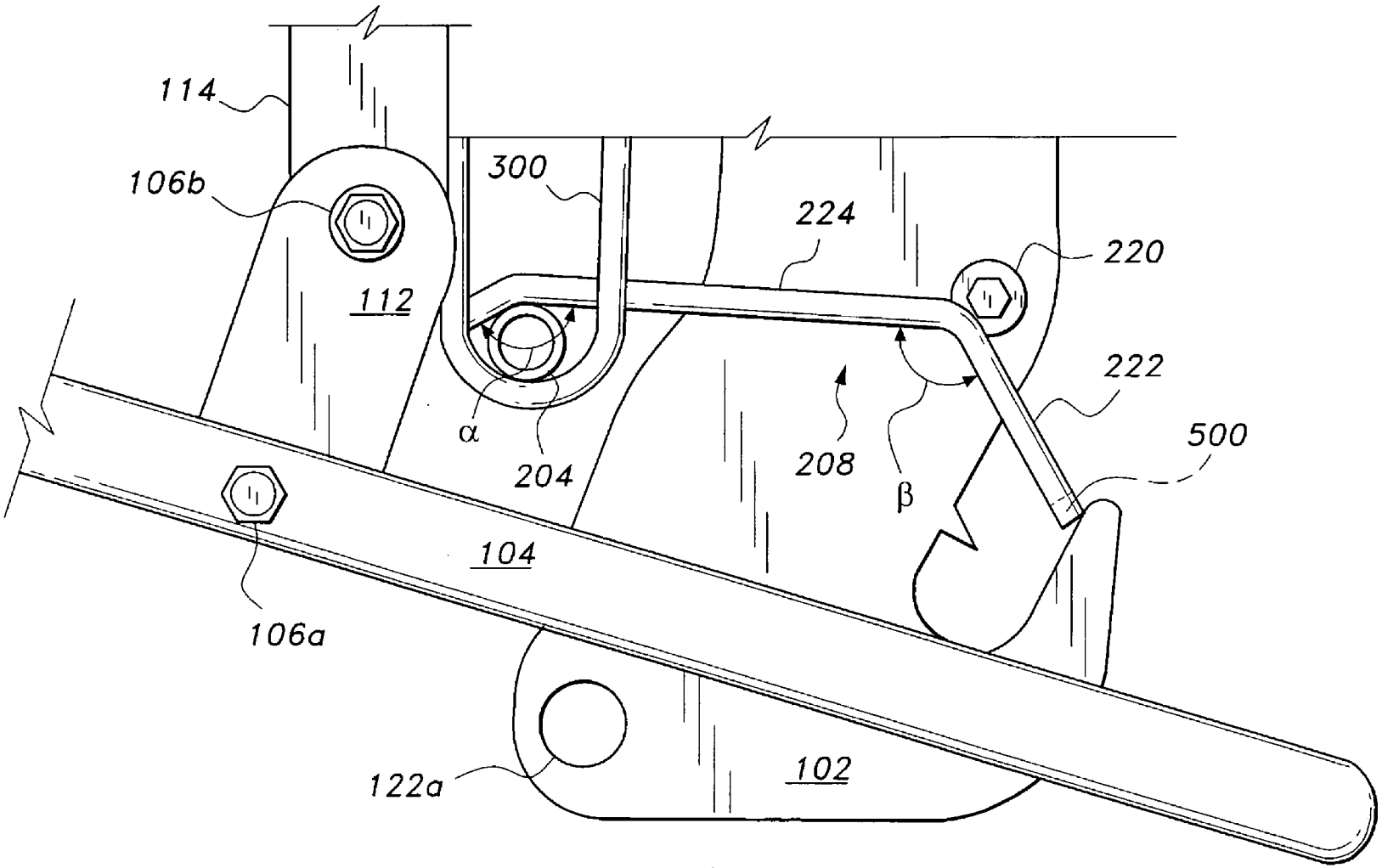
FIG. 3 is an end view of the cargo spreader bar according to the present invention.

As shown in FIGS. 2 and 3, the locks 208 are elongated rigid members that are pivotally attached to both sides of the hooks 102 at pivot points 220, defined by bolts or pivot pins. A first arm 222 of the locking member 208 has sufficient length to extend laterally outward from the pivot point 220 to the tip of the hook 102 in order to fully enclose an end link of a chain CH or sling loop in the hook 102 when the lock member 208 is pivoted in a counterclockwise direction. To facilitate retention of the chains CH in the hook 102, the locking member 208 is folded back to form a buckle-shaped boss 500 at the point of contact with the tip of the hook 102 before extending to the opposing pivot point 220 on the opposite side of the mouth of the hook 102.

A second arm 224 of the locking member 208 extends laterally inward from the pivot points 220 to engage a safety lock control bar 204. Vertical movement of the safety lock control bar 204 provides counterclockwise or clockwise pivoting action of the locking members 208, depending on direction of the vertical motion. As shown in FIG. 3, the safety lock control bar 204 may be laterally constrained by U shaped members 300 suspended from the frame of spreader bar 100 to envelope the control bar 204, in addition to providing a stop of downward vertical movement of the control bar 204. Additionally, the safety lock control bar 204 may be a compound member comprised of an elongated member having a U shaped channel within which is joined a tubular member of similar dimension. Locking member 208 may have a first angled bend $\alpha$ proximate to the point of contact with safety lock control bar 204, and a second angled bend $\beta$ proximate the pivot point 220.

Referring to FIG. 2, the control bar 204 is attached to a control arm 207 of a safety lock actuator 206 to provide the vertical actuation of the control bar 204. The control bar attachment to control arm 207 may be accomplished via a clevis pin and receiver or other suitable fastener, such as control bar fastening system 320. In the embodiment shown in FIG. 1B, there are six control actuators 206, three on each longitudinal side of the spreader bar 100. Each control actuator 206 is fixedly attached to the frame at an upper surface, or one of the cross members 118. There are two safety lock control bars 204, one being provided for each longitudinal side of the spreader bar 100.

A tubular chain lifter 104 extends longitudinally in a substantially parallel manner to one of the longitudinal frame members 120 and is pivotally mounted to vertical extensions 114 of the frame at front and back ends of the frame via two solid bodied pivot links 112. As shown in FIG. 3, for each of the pivot links 112, opposing ends of the pivot link 112 pivotally attach respectively to a laterally extending section of the chain lifter 104 at pivot point 106*a*, and to the frame vertical extension 114 at pivot point 106*b*. A laterally extending section of the chain lifter 104 extends sufficiently so that outboard longitudinal section of the chain lifter 104 can swing up or down in close proximity to the hooks 102. A second chain lifter 104 is similarly mounted and extends along the remaining longitudinal frame member 120.

Figure 4:
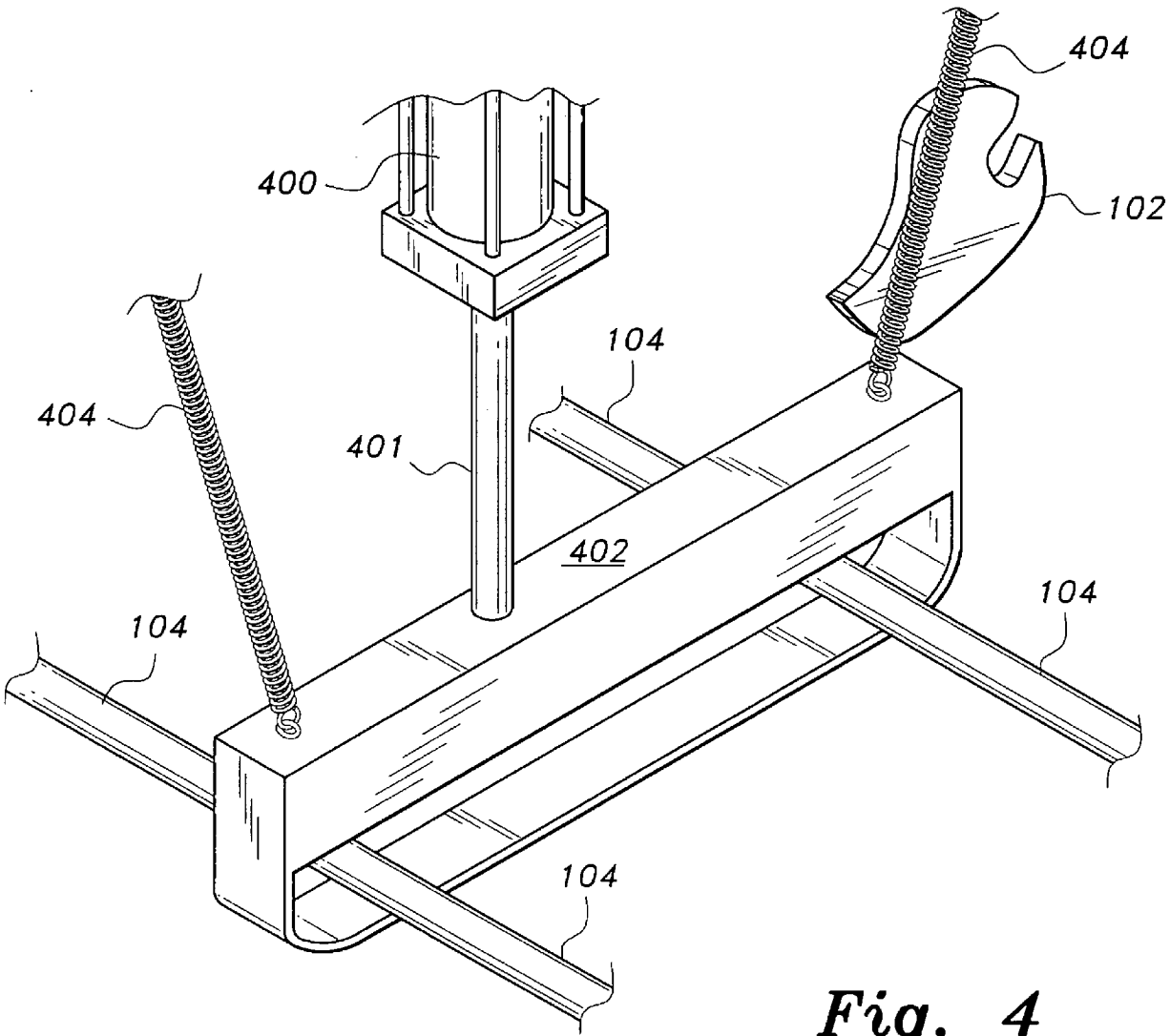
FIG. 4 is a partial perspective view of the chain lifter pivot actuator of the cargo spreader bar according to the present invention.

As shown in FIG. 4, inside sections of the tubular chain lifters 104 are coupled to a chain lifter actuator 400 by means of coupling device 402. Coupling device 402 is a laterally extending D shaped member that retains the inside sections of the chain lifters 104 within its opening. Upward and downward motion of the coupling device 402 results in corresponding upward and downward movement of the chain lifter inside sections.

As shown in FIGS. 1B and 4, the chain lifter pivot actuator 400 is fixedly attached to the frame of spreader bar 100, leaving the actuator arm 401 free to engage the coupling device 402 for vertical actuation of the coupling device 402 to impart the pivoting action of the chain lifters 104. Preferably, the chain lifters 104 are disposed relative to their pivot points at pivot links 112 so that gravity keeps the chain lifters 104 in a lowered position away from the chain hooks 102 in order to avoid inadvertent dislodging of the chains during cargo transport. Additionally, as shown in FIG. 4, tension springs 404 may be disposed on opposing inboard sides of the frame and attached to a spring attachment point on correspondingly opposing sides of the coupling device 402 so that the inboard sections of the chain lifters 104 are normally raised in order to keep the outboard sections normally lowered, i.e., away from the chain hooks 102. Thus, a downward thrusting of the lifter actuator arm 401 is required in order to initiate lifting action of chain lifters 104.

When the safety locking members 208 are disengaged, the chain lifter actuator arm 400 can be commanded to extend downward to cause inside sections of the chain lifters 104 to pivot downward. The pivotal attachments of the tubular chain lifters 104 permit the outside sections of the lifters 104 to pivot upward, coming in contact with the chains CH to sweep the chains CH upward and away from the hooks 102 as the inside sections swing downward, thereby releasing the chains CH from the hooks 102.

Loading another cargo comprises keeping the safety locking members 208 open; placing the chains CH on the hooks 102; then closing the safety locking members 208. After the cargo is transported to a desired position, the safety locking members 208 are then opened and the chain lifters 104 are activated to release the loops of chains CH from the hooks 102.

It should be noted that the aforementioned actuators 206 and actuator 400 can be of any type, including but not limited to air cylinders, electromagnetic actuators, motor driven actuators, and the like. In the embodiment shown, actuators 206 and actuator 400 are air cylinders powered by an onboard air compressor system 505. Additionally, fuel and/or power sources such as electric power supplies, petrochemical fuel tanks, air tanks, and the like may be disposed on the cargo spreader bar 100. In the embodiment shown, the onboard air compressor system 505 is attached at one of the lateral cross members 118. Air tubing (not shown) is routed from the compressor system 505 to the actuators 206 and 400.

Optional compressed air bottles (not shown) may be provided with similar air tube routing to the actuators 206 and 400 as a backup in the event that the compressor system 505 fails. Control of the actuators can be provided by a control unit (not shown) that is remote from the spreader bar 100.

It is to be understood that the present invention is not limited to the embodiments described above, but encompasses any and all embodiments within the scope of the following claims.

The invention claimed is:

1. A cargo spreader bar, comprising:

a pair of longitudinal frame members and a pair of end members defining a substantially rectangular frame;

a plurality of lateral cross members extending across the rectangular frame;

a plurality of outwardly disposed hooks slidably attachable to and extending below each of the longitudinal frame members, each of the hooks having a point defining an open mouth;

a plurality of chains, each of the chains having a first end pivotally attached to a lower rear section of the hooks and a second end releasably attached over the point of the corresponding hook, the chains forming loops for lifting cargo;

pivoting safety locking members attached to the hooks, the locking members being pivotal across the mouth of the hooks to secure the chain loops within the hooks;

at least one safety locking member control actuator attached to the frame and selectively pivoting the locking members open and closed across the mouths of the hooks;

for each longitudinal frame member, a chain lifter pivotally attached to the frame, each of the chain lifters having an outboard, elongated longitudinal rail selectively pivotal upward parallel to the frame to lift the chains upward and release the second ends from the hooks when the locking members are pivoted open; and a chain lifter actuator connected to the chain lifters.

2. The cargo spreader bar according to claim 1, wherein said longitudinal frame members have vertically tapered front and rear sections.

3. The cargo spreader bar according to claim 1, further comprising: a T-bar rigidly attached to an associated longitudinal frame member, the T-bar having notched regions for slidable attachment of said hooks.

4. The cargo spreader bar according to claim 3, wherein the hooks have hanger arms removably insertable into the notched regions of the T bar slots to facilitate hanging the hooks from the T-bar.

5. The cargo spreader bar according to claim 1, wherein each said safety locking member has a folded back portion forming a buckle-shaped boss at a point of contact with the tip of a corresponding said hook in order to facilitate attachment of the attached chain to the hook.

6. The cargo spreader bar according to claim 1, further comprising: a safety lock control bar, the safety lock control bar extending longitudinally along the spreader bar and being in contact with ends of each of the pivoting safety locking members; the safety lock control bar being attached to the safety locking member control actuator; the safety lock control bar being movable responsive to the safety locking member control actuator to cause the pivoting safety locking members to open and close across the mouths of the hooks.

7. The cargo spreader bar according to claim 6, further comprising: at least one constraining member disposed in relation to the frame of the spreader bar to constrain the safety lock control bar in at least one degree of freedom during actuator movement of the control bar.

8. The cargo spreader bar according to claim 6, wherein each said pivoting safety locking member has a first angled bend $\alpha$ proximate to the point of contact with the safety lock control bar, and a second angled bend $\beta$ proximate the pivot point of the pivoting safety locking member.

9. The cargo spreader bar according to claim 1, wherein further comprising a coupling member translating actuator motion into pivotal motion of the chain lifters to facilitate selective pivotal chain releasing motion of the chain lifters.

10. The cargo spreader bar according to claim 9, further comprising: tension springs disposed on opposing inboard sides of the frame, the springs being attached to a spring attachment point on correspondingly opposing sides of the coupling member so that the inboard sections of the chain lifters are normally raised in order to keep the outboard sections normally lowered away from the chain hooks.

* * * * *